US008939112B2

(12) United States Patent
Kikuchi

(10) Patent No.: US 8,939,112 B2
(45) Date of Patent: Jan. 27, 2015

(54) BUCKSTAY CONNECTING SYSTEM

(75) Inventor: Katsumi Kikuchi, Tokyo (JP)

(73) Assignee: IHI Corporation (JP)

( * ) Notice: Subject to any disclaimer, the term of this patent is extended or adjusted under 35 U.S.C. 154(b) by 678 days.

(21) Appl. No.: 12/907,423

(22) Filed: Oct. 19, 2010

(65) Prior Publication Data

US 2011/0094455 A1 Apr. 28, 2011

(30) Foreign Application Priority Data

Oct. 22, 2009 (JP) ..... 2009-243278

(51) Int. Cl.
*F22B 37/24* (2006.01)
*F22B 21/00* (2006.01)
*F22B 37/20* (2006.01)

(52) U.S. Cl.
CPC ..... *F22B 37/208* (2013.01); *F22B 37/244* (2013.01); *F22B 21/00* (2013.01)
USPC ..... 122/493; 122/510

(58) Field of Classification Search
USPC ..... 122/493, 510, 511, 512
See application file for complete search history.

(56) References Cited

U.S. PATENT DOCUMENTS 2,583,599 A 1/1952 Schoessow
2,773,487 A 12/1956 Walter
3,301,225 A * 1/1967 Boe et al. ..... 122/510
3,814,063 A * 6/1974 Bijmholt ..... 122/6 A
5,317,993 A * 6/1994 Payne ..... 122/510
5,865,149 A * 2/1999 Patel ..... 122/510
8,333,170 B2 * 12/2012 Zaman ..... 122/512

FOREIGN PATENT DOCUMENTS

| | | |
|---|---|---|
| FR | 1452490 A | 2/1966 |
| JP | 1-94704 | 6/1989 |
| JP | 2-140108 | 11/1990 |
| JP | 2001-041408 | 2/2001 |
| JP | 2001-221404 | 8/2001 |
| JP | 2002-257303 | 9/2002 |

OTHER PUBLICATIONS

Japanese Notice of Allowance, dated Sep. 10, 2013, issued in corresponding Japanese Application No. 2009-243278. English translation included. Total 6 pages.
European Search Report, dated Oct. 15, 2014, issued in corresponding European Patent Application No. 10251820.6. Total 6 pages.

* cited by examiner

*Primary Examiner* — Gregory A Wilson
(74) *Attorney, Agent, or Firm* — Ostrolenk Faber LLP

(57) ABSTRACT

A buckstay connecting system includes a socket part that is fixed to the horizontal buckstay being separated from a lower end of the vertical buckstay between the lower end of the vertical buckstay and the horizontal buckstay, and an insertion part that is fixed to a lower portion of the vertical buckstay, is inserted into the socket part so as to be able to slide in a vertical direction, inhibits the horizontal buckstay from being inclined, and is allowed to be fastened to the socket part.

6 Claims, 4 Drawing Sheets

BUCKSTAY CONNECTING SYSTEM

BACKGROUND OF THE INVENTION

1. Field of the Invention

The present invention relates to a buckstay connecting system, and more particularly, to a buckstay connecting system for connecting a vertical buckstay installed in a height direction of a furnace with a horizontal buckstay installed in a width direction of the furnace.

This application claims priority to and the benefits of Japanese Patent Application No. 2009-243278 filed on Oct. 22, 2009, the disclosure of which is incorporated herein by reference.

2. Background Art

As is widely known, furnaces installed on, for example, thermal electric power plants have a furnace wall made up of a plurality of water pipes and fins interposed between the water pipes.

The furnace wall is supported in such a way that it is suspended from a building covering to build a furnace, and thus has weak stiffness. For this reason, in order to enhance the stiffness of the furnace wall and to inhibit the furnace from being greatly deformed by thermal expansion of the furnace wall or pressure variation in the furnace, a plurality of buckstays are disposed around the furnace.

These buckstays are made up of horizontal buckstays horizontally installed along the furnace wall around the furnace and vertical buckstays vertically installed along the furnace wall around the furnace. Each buckstay is formed of, for example, H-section steel.

[Patent Document 1] Japanese Patent Application Publication No. 2001-221404

However, the buckstays prevent excessive deformation of the furnace, but fail to perfectly inhibit such deformation. As such, when the furnace is deformed by thermal expansion, this leads to displacement of the buckstays.

The buckstays are typically made up of vertical buckstays installed in a height direction of the furnace and horizontal buckstays installed in a width direction of the furnace. Although these vertical and horizontal buckstays are interconnected, the vertical buckstays are displaced in a vertical direction with respect to the horizontal buckstays due to the above-mentioned deformation of the furnace. For this reason, the vertical buckstays are connected to be able to slide in the vertical direction with respect to the horizontal buckstays.

In greater detail, the horizontal buckstays are installed in multiple steps in the height direction of the furnace, and the vertical buckstays are installed between the multiple steps. Each vertical buckstay is welded and fixed to the horizontal buckstay disposed just above an upper end thereof and is inserted into a box-shaped socket part installed on the horizontal buckstay disposed just below a lower portion including a lower end thereof. Here, the lower end of the vertical buckstay is not fixed to the horizontal buckstay but is only inserted into the socket part. Thus, when the vertical buckstay is displaced in the vertical direction with respect to the horizontal buckstay, the vertical buckstay slides in the vertical direction with respect to the horizontal buckstay.

In this manner, the vertical buckstay slides in the vertical direction with respect to the horizontal buckstay, but its lower end is always located in the socket part. As such, the vertical buckstay can always come into contact with the surface of an inner wall of the socket part. Thereby, the horizontal buckstay is prevented from falling.

During construction of thermal electric power plants, or the like, when these buckstays are installed around the furnace, the horizontal buckstays are first installed, and then the vertical buckstays are installed between the horizontal buckstays. However, since it is necessary to inhibit the falling of the horizontal buckstays until the upper ends of the vertical buckstays functioning to prevent the horizontal buckstays from falling are welded to their upper horizontal buckstays and the lower portion of the vertical buckstays are inserted into the socket parts installed on their lower horizontal buckstays, temporary construction materials supporting the horizontal buckstays are installed around the furnace. Since these temporary construction materials need to support all the horizontal buckstays ready to fall in a horizontal state, too many construction materials are required. Further, after all of the vertical buckstays are installed, all of the temporary construction materials need to be removed. As such, the temporary construction materials for supporting the horizontal buckstays are attributed to increasing the period and cost of construction when constructing, for example, the thermal electric power plant.

Further, when the vertical buckstays are installed in a construction field, the upper ends of the vertical buckstays are welded to the horizontal buckstays, and then socket parts are welded to the horizontal buckstays so as to surround the lower portion of the vertical buckstays. For this reason, the welding work is great in the construction field, which leads to increasing the period and cost of construction.

SUMMARY OF THE INVENTION

The present invention has been made in view of the above-described circumstances, and an object of the invention is to provide a buckstay connecting system, which attempts to reduce a burden on welding work required to connect a vertical buckstay with a horizontal buckstay and to reduce construction materials required for temporary construction materials for preventing the horizontal buckstay from falling.

According to a first aspect of the present invention, a buckstay connecting system is provided for connecting a vertical buckstay installed in a height direction of a furnace with a horizontal buckstay installed in a width direction of the furnace. The buckstay connecting system includes: a socket part that is fixed to the horizontal buckstay being separated from a lower end of the vertical buckstay between the lower end of the vertical buckstay and the horizontal buckstay; and an insertion part that is fixed to a lower portion of the vertical buckstay, is inserted into the socket part so as to be able to slide in a vertical direction, inhibits an inclination of the horizontal buckstay with respect to a horizontal direction of the furnace and is allowed to be fastened to the socket part.

According to a second aspect of the present invention, the socket part and a lower portion of the insertion part is provided with bolt insertion holes, and the socket part and the insertion part may be fastened by aligning these insertion holes, and inserting and fixing bolts through the insertion holes.

According to a third aspect of the present invention, the insertion part may be fixed to the lower portion of the vertical buckstay by bolt fastening.

According to a fourth aspect of the present invention, the horizontal buckstay may be fixed to an upper portion of the vertical buckstay by bolt fastening.

According to a fifth aspect of the present invention, the vertical buckstay and the socket part may have H-shaped cross sections of the same size, have an H shape when viewed from the top, and be superposed when viewed from the top.

According to the present invention, the insertion part, which is fixed to the lower portion of the vertical buckstay and is inserted into the socket part so as to be able to slide in a vertical direction, can be fastened to the socket part. As such, when the horizontal and vertical buckstays are installed, the insertion part is fastened to the socket part, so that the vertical buckstay and the horizontal buckstay are firmly coupled. For this reason, the vertical buckstay can receive at least a part of a load caused by the horizontal buckstay ready to fall, and thus it is possible to reduce construction materials of conventional temporary construction materials, or to install the horizontal buckstay and the vertical buckstay without installing the conventional temporary construction materials.

Further, when the installation of the horizontal buckstay and the vertical buckstay is completed, and the horizontal buckstay can be supported by, for example, the furnace wall, the insertion part, i.e. the vertical buckstay, can slide in the vertical direction with respect to the horizontal buckstay by unfastening of the insertion part and the socket part. Further, the horizontal buckstay is prevented from falling by the contact between the insertion part and inner walls of the socket part.

Further, according to the present invention, the insertion part is separated from the vertical buckstay. Thereby, the total length of the vertical buckstay becomes short, and it is possible to dispose the socket part between the vertical buckstay and its lower horizontal buckstay. As such, when the horizontal buckstay and the vertical buckstay are installed, the vertical buckstay does not interfere with the socket part, and it is possible to weld the socket part to the horizontal buckstay in advance in a factory. Thus, according to the present embodiment, it is possible to reduce a burden on welding work in a construction field.

As described above, according to the present invention, it is possible to reduce the burden on the welding work required to connect the vertical buckstay with the horizontal buckstay and to reduce the construction materials required for the temporary construction materials for preventing the horizontal buckstay from falling.

DETAILED DESCRIPTION OF THE INVENTION

Figure 1:
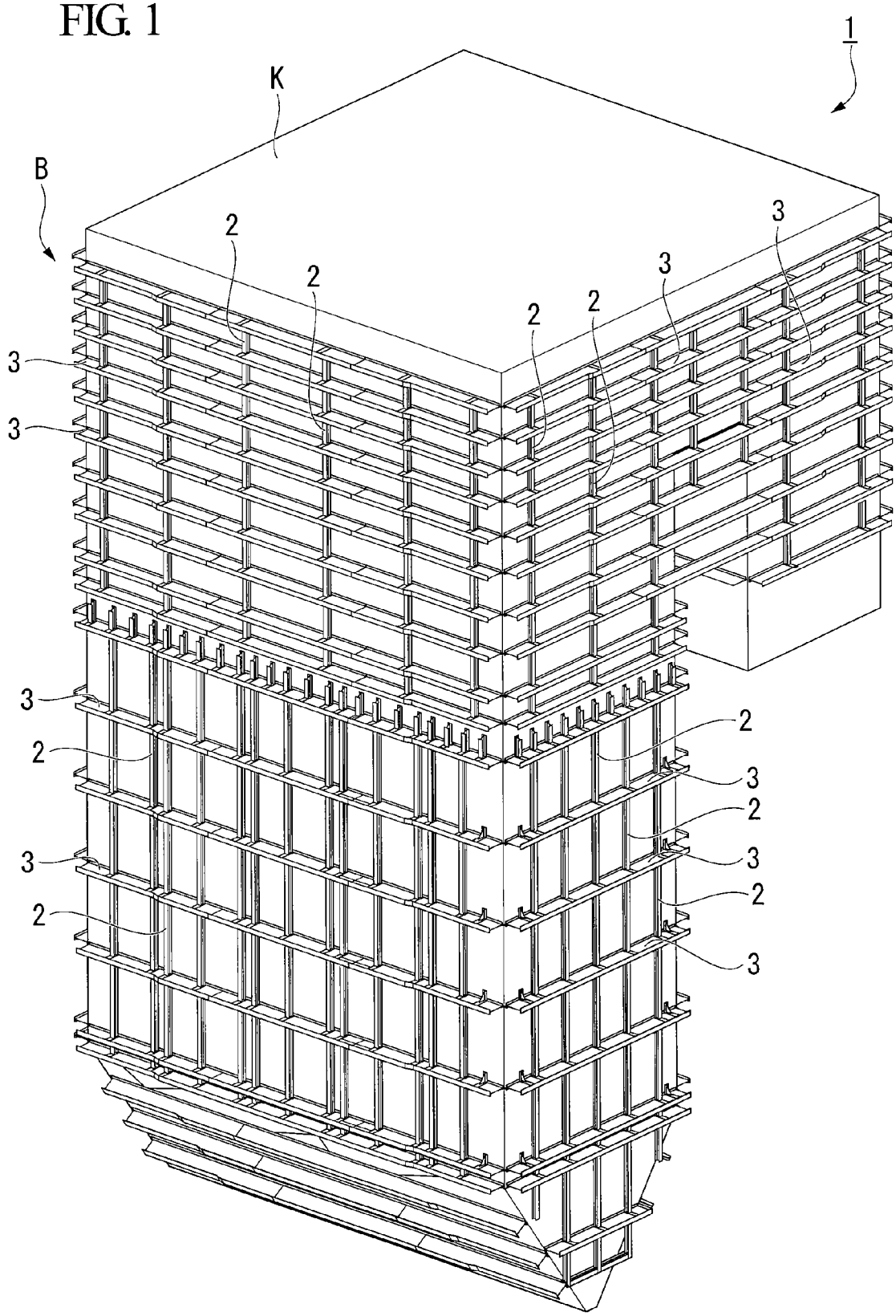
FIG. 1 is a perspective view of a buckstay installed around a furnace.

Hereinafter, an embodiment of a buckstay connecting system related to the present invention will be described with reference to the accompanying drawings. Further, in the drawings, the scale of each member is appropriately modified so as to make the size of each member recognizable.

FIG. 1 is a perspective view of a buckstay 1 installed around a furnace B. The buckstay 1 is disposed a predetermined distance apart from a furnace wall of the furnace B, and is connected with the furnace B by supports (not shown), thereby inhibiting deformation of the furnace B. The buckstay 1 itself is supported by suspension from, for example, a support structure K installed on the furnace B along with the furnace B.

As shown in FIG. 1, the buckstay 1 is made up of vertical buckstays 2 installed in a height direction of the furnace B, and horizontal buckstays 3 installed in a width direction of the furnace B.

The horizontal buckstays 3 are disposed so as to surround the entire circumference of the furnace B when viewed from the top, and are installed in multiple steps in the height direction.

The vertical buckstays 2 are installed between every step of the horizontal buckstays 3. The vertical buckstays 2 function as a spur for preventing the horizontal buckstays 3 from falling, in addition to functioning as the above-mentioned buckstays. In greater detail, since sides of the horizontal buckstays 3 near the furnace wall of the furnace B are connected to the furnace wall of the furnace B by the supports (not shown), the horizontal buckstays 3 intend to incline around the connections between the horizontal buckstays 3 and the supports and fall due to the own weight of each horizontal buckstay 3. In this regard, the vertical buckstays 2 are installed between the horizontal buckstays 3 spaced apart from each other in the vertical direction, thereby preventing the horizontal buckstays 3 from falling.

Further, in the present embodiment, these vertical and horizontal buckstays 2 and 3 are formed of H-section steel. Furthermore, the vertical buckstays 2 are formed of H-section steel having a smaller cross-sectional area, compared to the horizontal buckstays 3.

The buckstay connecting system 10 of the present embodiment connects the above-mentioned vertical and horizontal buckstays 2 and 3.

Figure 2:
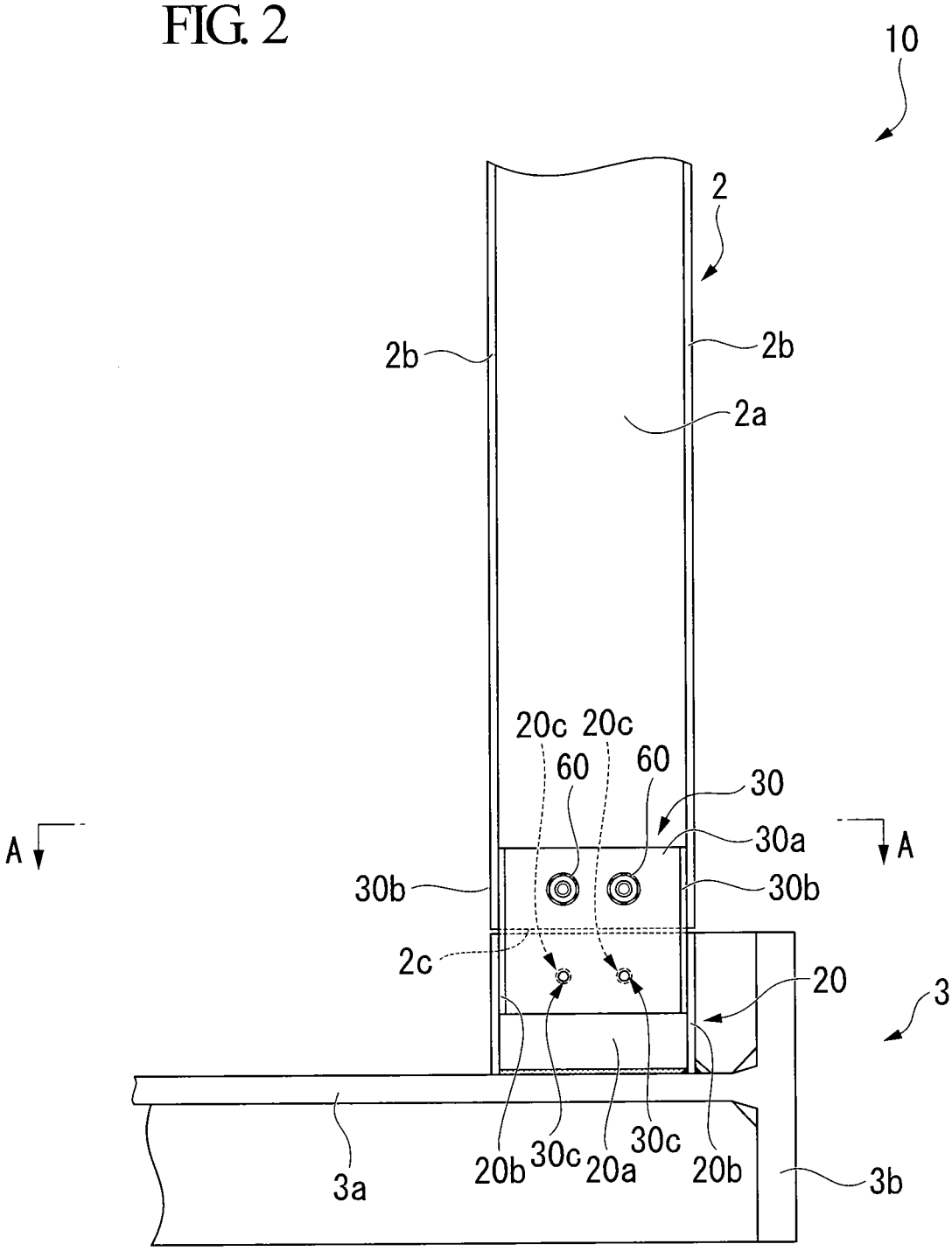
FIG. 2 is a side view of a vertical buckstay and a horizontal buckstay, including a buckstay connecting system according to one embodiment of the present invention.
Figure 3A:
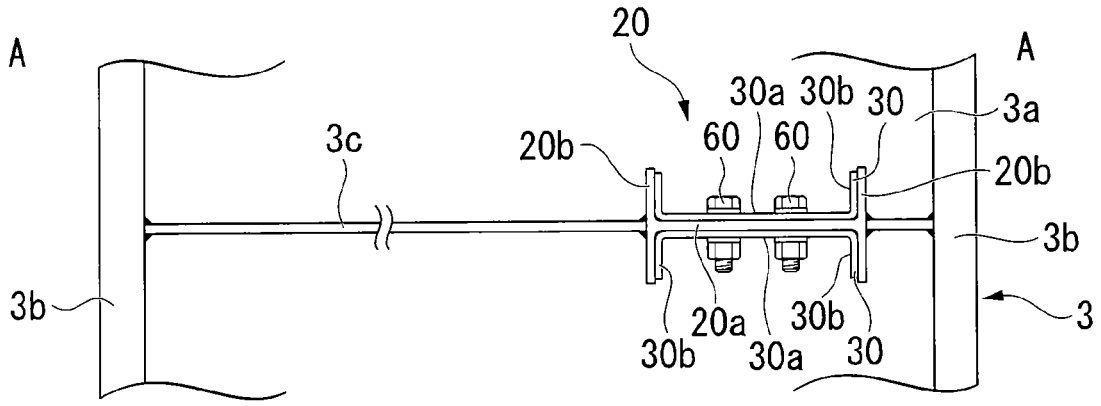
FIG. 3A is a cross-sectional view taken along line A-A of FIG. 2.
Figure 3B:
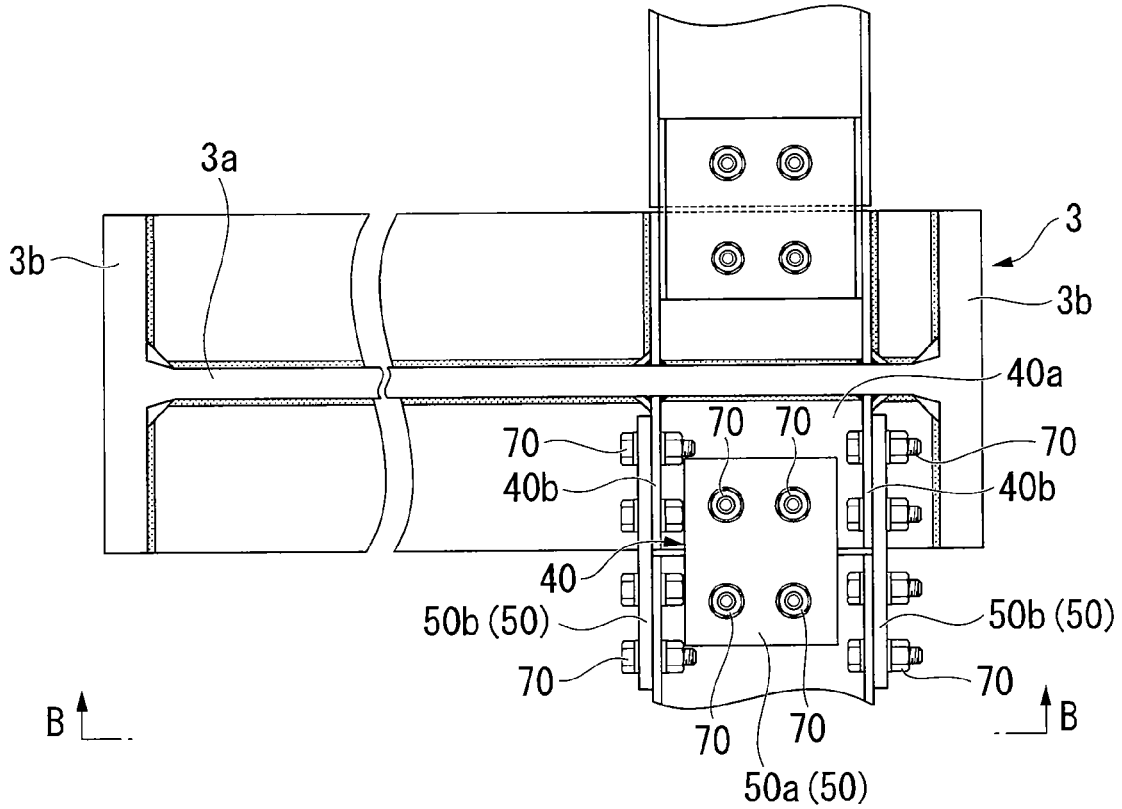
FIG. 3B is a side view of an upper fixture part of a buckstay connecting system according to one embodiment of the present invention.
Figure 4:
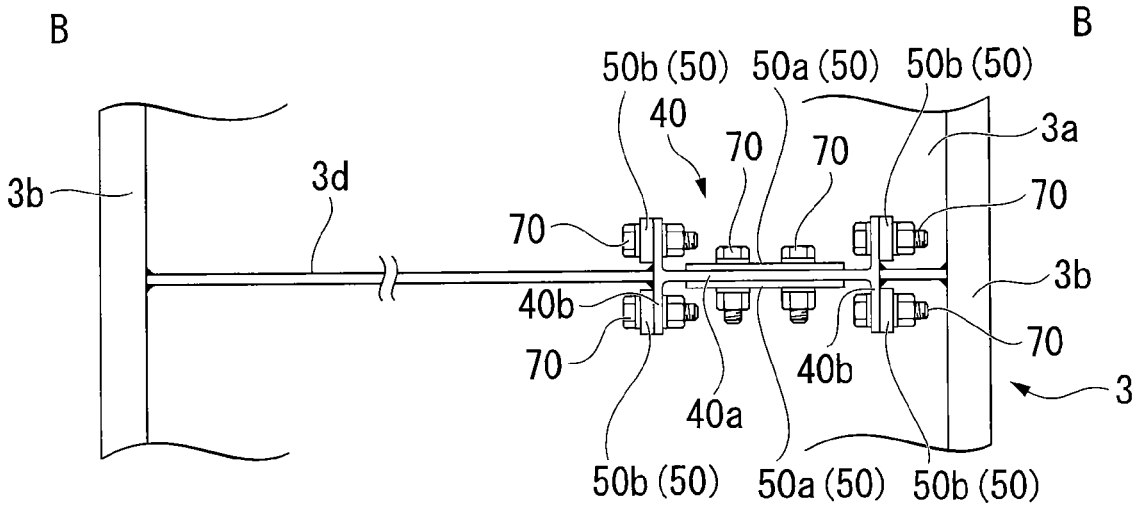
FIG. 4 is a cross-sectional view taken along line B-B of FIG. 3B.

FIG. 2 is a side view of the vertical buckstay 2 and the horizontal buckstay 3, including the buckstay connecting system 10. Further, FIG. 3A is a cross-sectional view taken along line A-A of FIG. 2, and FIG. 3B is a side view of an upper fixture part of a buckstay connecting system in an embodiment of the present invention. FIG. 4 is a cross-sectional view taken along line B-B of FIG. 3B.

In the present embodiment, as shown in FIG. 2, a posture of the horizontal buckstay 3 is configured such that its web 3*a* is horizontal, and its flanges 3*b* are arranged in a direction where they are separated from the furnace wall. Further, a posture of the vertical buckstay 2 is configured such that its web 2*a* is vertical, and its flanges 2*b* are arranged in a direction where they are separated from the furnace wall.

As shown in FIGS. 2 through 4, the buckstay connecting system 10 of the present embodiment includes a socket part 20, lower splice plates (insertion parts) 30, an upper fixture part 40, and an upper splice plate 50.

The socket part 20 is configured so that the lower splice plates 30 are inserted thereinto, and is disposed between a lower end 2*c* of the vertical buckstay 2 and the horizontal buckstay 3. The socket part 20 has an upper end slightly separated from the lower end 2*c* of the vertical buckstay 2 and a lower end fixed to the web 3*a* of the horizontal buckstay 3 by welding. Further, a rib 3*c* is formed between the flanges 3*b* on the web 3*a* of the horizontal buckstay 3, and the socket part 20 is also firmly fixed to this rib 3*c* by welding.

As shown in FIG. 3A, the socket part 20 has an H-shaped cross section having the same size as the vertical buckstay 2, and a posture of the socket part 20 is configured such that its web 20*a* is vertical and its flanges 20*b* are arranged in a direction where they are separated from the furnace wall, like the vertical buckstay 2. The socket part 20 and the vertical buckstay 2 are disposed in parallel in the vertical direction so as to overlap each other when viewed from the top.

Further, the web 20*a* of the socket part 20 is provided with two through-holes 20*c*, through which bolts can be inserted, in an upper portion thereof in parallel to the horizontal direction.

The lower splice plates 30 are fixed to the lower portion of the vertical buckstay 2, and are inserted into the socket part 20 so as to be able to slide in the vertical direction. More particularly, in the present embodiment, the lower splice plates 30 are each inserted into an area that is surrounded by the web 20*a* and the flanges 20*b* of the socket part 20.

As shown in FIG. 3A, each lower splice plate 30 includes a central portion 30*a*, which is in contact with a wall surface of the web 20*a* of the socket part 20, and bent portions 30*b*, which are in contact with wall surfaces of the flanges 20*b* of the socket part 20, and is an approximately C-shaped plate member when viewed from the top. The lower splice plates 30 are installed on opposite sides of the socket part 20, and thus the total of two lower splice plates 30 are installed.

Further, each lower splice plate 30 is fixed to the lower portion of the vertical buckstay 2 by two bolts 60. That is, the lower splice plates 30 are fixed to the lower portion of the vertical buckstay 2 by bolt-fastening.

In the buckstay connecting system 10 of the present embodiment, the lower splice plate 30 is provided with through-holes 30*c*, through which bolts are inserted, in a lower portion thereof. Like the through-holes 20*c*, the two through-holes 30*c* are formed in parallel in the horizontal direction so as to overlap the through-holes 20*c* formed in the web 20*a* of the socket part 20.

In other words, in the buckstay connecting system 10 of the present embodiment, the through-holes 20*c* and the through-holes 30*c* overlap to insert the bolts and mount nuts, so that the lower splice plates 30 can be fastened to the socket part 20.

As shown in FIGS. 3B and 4, the upper fixture part 40 is formed of H section steel having the same size as the socket part 20, and is fixed to a lower surface of the web 3*a* of the horizontal buckstay 3 by welding. Further, a rib 3*d* is formed between the flanges 3*b* on the lower surface of the web 3*a* of the horizontal buckstay 3. The upper fixture part 40 is also firmly fixed to this rib 3*d* by welding. The upper fixture part 40 is disposed so as to overlap the vertical buckstay 2 when viewed from the top, like the socket part 20.

The upper splice plate 50 shown in FIGS. 3B and 4 is a plate member for connecting the upper portion of the vertical buckstay 2 with the upper fixture part 40. The upper fixture part 40 and the vertical buckstay 2 are fastened to the upper splice plate 50 by bolts 70, and thereby are connected to each other.

Further, as shown in FIG. 4, the upper splice plate 50 includes two web connecting plates 50*a* for connecting the web 2*a* of the vertical buckstay 2 with the web 40*a* of the upper fixture part 40, and four flange connecting plates 50*b* for connecting the flanges 2*b* of the vertical buckstay 2 with the flanges 40*b* of the upper fixture part 40.

In the buckstay connecting system 10 of the present embodiment having this construction, when the lower splice plates 30 are not fastened to the socket part 20, the positional relationship of the height directions of the vertical buckstay 2 and the horizontal buckstay 3 varies when the furnace B is expanded or contracted in the height direction by, for example, thermal expansion. Even in this case, according to the buckstay connecting system 10 of the present embodiment, the lower splice plates 30 slide in the state where they are inserted into the socket part 20, so that it is possible to prevent stress from being applied to the vertical buckstay 2 or the horizontal buckstay 3.

Further, since the bent portions 30*b* of the lower splice plates 30 are in contact with the wall surface of the flanges 20*b* of the socket part 20, even when the flange 3*b* of the horizontal buckstay 3 on the side separated from the furnace wall is about to be inclined downwards, the horizontal buckstay 3 can inhibit such inclination.

According to the buckstay connecting system 10 of the present embodiment, during construction of the thermal electric power plant, when the horizontal and vertical buckstays are installed around the furnace B, the lower splice plates 30 are fastened to the socket part 20, so that the vertical buckstay 2 and the horizontal buckstay 3 are firmly coupled. For this reason, the vertical buckstay 2 can receive at least part of a load caused by the horizontal buckstay 3 about to fall during the installation, and thus it is possible to reduce the construction materials of the conventional temporary construction materials, or it is possible to install the horizontal buckstay 3 and the vertical buckstay 2 without installing the conventional temporary construction materials.

Further, when the installation of the horizontal buckstay 3 and the vertical buckstay 2 is completed, and the horizontal buckstay 3 can be supported by, for example, the furnace wall, the lower splice plates 30, i.e. the vertical buckstay 2, can slide in the vertical direction with respect to the horizontal buckstay 3 by unfastening of the lower splice plates 30 and the socket part 20. Further, the horizontal buckstay 3 is prevented from falling by the contact between the lower splice plates 30 and the wall surfaces of the socket part 20.

Further, according to the buckstay connecting system 10 of the present embodiment, the lower splice plates 30 are separated from the vertical buckstay 2. Thereby, the total length of the vertical buckstay 2 becomes short, and it is possible to dispose the socket part 20 between the vertical buckstay 2 and its lower horizontal buckstay 3. As such, when the horizontal buckstay 3 and the vertical buckstay 2 are installed, the vertical buckstay 2 does not interfere with the socket part 20, and it is possible to weld the socket part 20 to the horizontal buckstay 3 in advance in a factory. Thus, according to the buckstay connecting system 10 of the present embodiment, it is possible to reduce a burden on welding work in the construction field.

As described above, according to the buckstay connecting system 10 of the present embodiment, it is possible to reduce the burden on the welding work required to connect the vertical buckstay 2 with the horizontal buckstay 3 and to reduce the construction materials required for the temporary construction materials for preventing the horizontal buckstay 3 from falling.

Further, according to the buckstay connecting system 10 of the present embodiment, the bolt insertion holes 30*c* and 20*c* are formed in the lower portions of the lower splice plates 30 and the socket part 20 in advance. These insertion holes are aligned, and the bolts are inserted and fixed through the insertion holes.

As such, according to the buckstay connecting system 10 of the present embodiment, it is possible to fasten the lower splice plates 30 and the socket part 20 in a more simple way and to unfasten the lower splice plates 30 and the socket part 20 with ease.

Further, in the buckstay connecting system 10 of the present embodiment, the upper portion of the vertical buckstay 2 and the horizontal buckstay 3 are fixed by the upper fixture part 40 and the upper splice plate 50 by bolt fastening.

As such, the upper portion of the vertical buckstay 2 and the horizontal buckstay 3 can be fixed without welding the upper portion of the vertical buckstay 2 and the horizontal buckstay 3. Thus, it is possible to further reduce the burden on the welding work required to connect the vertical buckstay 2 with the horizontal buckstay 3.

Embodiments of the present invention have been described with reference to the drawings. However, the present invention is not limited to these embodiments. The various shapes and combinations of each composite member shown in the embodiment described above refer to only a single example, and may be altered in various ways based on design requirements and so forth within a scope that does not deviate from the subject matter of the present invention.

For example, in the above-mentioned embodiment, the vertical buckstay 2, the horizontal buckstay 3, the socket part 20, and the like have been described as being formed of H-section steel.

However, the present invention is not limited to this construction, and thus the vertical buckstay 2, the horizontal buckstay 3, the socket part 20, and the like may have different shapes.

Further, in the above-mentioned embodiment, the upper portion of the vertical buckstay 2 and the horizontal buckstay 3 have been described as being fixed by the upper fixture part 40 and the upper splice plate 50 by bolt fastening.

However, the present invention is not limited to this construction, and thus the upper portion of the vertical buckstay 2 and the horizontal buckstay 3 may be fixed by welding.

Example embodiments of the present invention have been described above. However, the present invention is not limited to these embodiments. Addition, omission, substitution, and other modifications to the construction within a scope that does not deviate from the gist of the present invention are also possible. The present invention is not limited by the description made above, and is limited only by the scope of the appended claims.

What is claimed is:

1. A buckstay connecting system for connecting a vertical buckstay installed in a height direction of a furnace with a horizontal buckstay installed in a width direction of the furnace, the vertical buckstay and the horizontal buckstay being capable of moving relative to each other in a vertical direction in accordance with deformation of the furnace, the buckstay connecting system comprising:

a socket part that is fixed to the horizontal buckstay being separated from a lower end of the vertical buckstay between the lower end of the vertical buckstay and the horizontal buckstay; and an insertion part that is fixed to a lower portion of the vertical buckstay, is inserted into the socket part so as to be able to slide in the vertical direction during relative movement of the vertical buckstay and the horizontal buckstay, inhibits an inclination of the horizontal buckstay with respect to a horizontal direction of the furnace, and is allowed to be fastened to the socket part, wherein the socket part includes a web and a pair of flanges, the pair of flanges being connected to both ends of the web in the horizontal direction, the insertion part includes a pair of central plates and two pairs of bent portions, a pair of bent portions being connected to both ends of each central plate in the horizontal direction, the pair of central plates is disposed so that the web is inserted therebetween in a thickness direction of the web, and the pair of bent portions is positioned between the pair of flanges, and is disposed so as to contact the pair of flanges.

2. The buckstay connecting system according to claim 1, wherein the socket part and a lower portion of the insertion part is provided with bolt insertion holes, and the socket part and the insertion part may be fastened by aligning these insertion holes, and inserting and fixing bolts through the insertion holes.

3. The buckstay connecting system according to claim 1, wherein the insertion part is fixed to the lower portion of the vertical buckstay by bolt fastening.

4. The buckstay connecting system according to claim 1, wherein another horizontal buckstay is fixed to an upper portion of the vertical buckstay by bolt fastening.

5. The buckstay connecting system according to claim 1, wherein the vertical buckstay and the socket part have H-shaped cross sections, which are the same size, have an H shape when viewed from the top and are superposed when viewed from the top.

6. The buckstay connecting system according to claim 1, wherein the web is provided with a first through-hole, and the pair of central plates is provided with second through-holes, and the insertion part is configured to be fastened to the socket part using a bolt being inserted into the first through-hole and the second through-holes.

* * * * *